United States Patent [19]

Bock et al.

[11] Patent Number: 4,730,813

[45] Date of Patent: Mar. 15, 1988

[54] OXYGEN NOZZLE FOR METAL REFINING

[75] Inventors: André Bock, Luxembourg; Romain Henrion; Jean Liesch, both of Esch; Carlo Heintz, Luxembourg; Henri Klein, Niedercorn; Jean-François Liesch, Esch, all of Luxembourg

[73] Assignee: Arbed S.A., Luxembourg, Luxembourg

[21] Appl. No.: 17,156

[22] Filed: Feb. 20, 1987

[30] Foreign Application Priority Data

Feb. 25, 1986 [LU] Luxembourg ..... 86321

[51] Int. Cl.[4] ..... C21C 5/32

[52] U.S. Cl. ..... 266/266; 266/225

[58] Field of Search ..... 266/218, 225, 265, 266, 266/267, 270

[56] References Cited

U.S. PATENT DOCUMENTS

| | | | |
|---|---|---|---|
| 1,873,996 | 8/1932 | Cunningham | 266/267 |
| 3,207,597 | 9/1965 | Hashimoto et al. | 266/267 |
| 4,349,382 | 9/1982 | Schleimer et al. | 75/59.25 |
| 4,366,953 | 1/1983 | Colling et al. | 266/266 |
| 4,533,124 | 8/1985 | Mercatoris | 266/266 |

FOREIGN PATENT DOCUMENTS

| | | | |
|---|---|---|---|
| 960856 | 1/1975 | Canada | 266/225 |
| 517638 | 8/1976 | U.S.S.R. | 266/266 |
| 817056 | 3/1981 | U.S.S.R. | 266/266 |
| 908812 | 2/1982 | U.S.S.R. | 266/267 |
| 1011699 | 4/1983 | U.S.S.R. | 266/266 |

*Primary Examiner*—L. Dewayne Rutledge
*Assistant Examiner*—Robert L. McDowell
*Attorney, Agent, or Firm*—Fishman & Dionne

[57] ABSTRACT

A nozzle for refining metals or ferroalloys by oxygen blasting from above the melt is presented. The nozzle terminates at a nozzle head and includes at least one central blast pipe for directing a jet of oxygen having supersonic speed. A chamber is interposed between the mouth of the blast pipe and the mouth of the nozzle head. This chamber widens progressively from the mouth of the blast pipe, and narrows toward the mouth of the nozzle head. At least one opening from at least one lateral duct opens to the chamber in the vicinity of the blast pipe mouth. Each lateral duct is connected to a source of gas, and includes an inidividual flow control valve. Preferably, at least three lateral ducts are arranged symmetrically around the blast pipe mouth.

9 Claims, 2 Drawing Figures

OXYGEN NOZZLE FOR METAL REFINING

BACKGROUND OF THE INVENTION

This invention relates to a nozzle for refining of metals or ferroalloys by blasts of oxygen from above the melt.

An oxygen blast nozzle normally comprises at least one vertical blast pipe for delivering a jet of oxygen for the refining operation. In addition, the blast nozzle may include at least one lateral blast pipe, for delivering a jet of oxygen which is less intense than the primary vertical jet. This lower intensity lateral jet burns the carbon monoxide formed in the course of refining; and creates a surplus of thermal energy (see for example Luxembourg patent LU No. 78 906). Also, the blast nozzle may include a pipe for conveying solid materials suspended in a carrier gas (see for example Luxembourg patent No. 84 433 corresponding to U.S. Pat. No. 4,533,124, which is assigned to the assignee hereof and incorporated herein by reference).

The primary vertical jet of oxygen strikes the surface of the bath, and must possess a sufficient impulse to traverse the bed of slag, or to drive it back, in order to reach the metal melt. It is also necessary for the jet to cause mixing of the slag with the bath, so as to accelerate the metallurgical reactions between these two liquid phases.

The point of impact of the jet on the surface of the bath is fixed; and is positioned substantially at the center of that surface. In order to be better able to distribute the intense heat present at the point of impact, and to intensify the mixing effect, it has long been known that it would be advantageous to be able to displace this point of impact in a controlled manner. Thus, nozzles have been proposed, whose principal axis is inclined, and the entirety of which can oscillate around the vertical axis of the bath. Also known have been nozzle heads whose mouth or opening include mechanical means by which the jet of oxygen can be deflected, these means themselves being movable and remote-controlled.

The disadvantage common to all of these proposed solutions is the need to operate mechanical components which are exposed to high temperatures, large quantities of dust, and the deleterious action of the oxygen. As a result, in almost all steelworks, only conventional blast nozzles with a unidirectional primary jet are to be found.

SUMMARY OF THE INVENTION

The above-described and other problems and deficiencies of the prior art are overcome or alleviated by the nozzle for refining metals of the present invention. In accordance with the present invention, a nozzle capable of delivering a guidable gas jet is provided wherein any movable mechanical means are reduced to a minimum so as to avoid the above-described problems. The nozzle includes at least one central blast pipe for directing a jet of oxygen having supersonic speed. A chamber is interposed between the mouth or opening of the blast pipe and the mouth or opening of the nozzle head. The chamber widens progressively from the mouth of the blast pipe and narrows toward the mouth of the nozzle head. At least one opening or mouth from a lateral duct opens to the chamber in the vicinity of the blast pipe mouth. Each lateral duct is connected to a source of gas, and includes an individual flow control valve. Preferably, at least three lateral ducts are arranged symmetrically around the blast pipe mouth.

The present invention operates as follows:

If a jet of oxygen is directed through a vertical blast pipe, the jet will have a vertical direction, and will behave in a conventional manner, well-known to steelmakers. However, if at the same time, oxygen or any other gas, is blown through a lateral duct, an overpressure zone is created within the chamber, which extends from the mouth of the lateral blast pipe to the outlet of the nozzle head, and causes a deflection of the jet leaving the orifice of the head. The lateral blast pipes or ducts are equipped with gas flow regulating valves, in order to create within the chamber the necessary conditions to form the jet, with respect to its impulse and its direction; or more precisely, its angle of deflection with respect to the vertical.

A major advantage of the blast nozzle of the present invention is that it enables the oxygen jet to be deflected, and the point of impact on the surface of the bath to be displaced, at will, and at a variable rate, without interruption of the gas flow. As a result, a substantial enlargement of the impact zone, and a more pronounced mixing of the metal with the slag on the surface of the bath is provided. Along with these favorable effects on the refining process, the displacement of the point of impact also causes an enlargement of the zone of after combustion (see Luxembourg patent LU No. 81 207 corresponding to U.S. Pat. No. 4,349,382 which is assigned to the assignee hereof and incorporated herein by reference). Another advantage offered by the present invention is a wider distribution of the heat present at the point of impact, with the result that on the one hand, the temperature of the bath can rise, and on the other hand, the zone of intense heat, where there exists the possibility of nitridation exists, can be displaced, and therefore diluted.

The above-discussed and other features and advantages of the present invention will be appreciated and understood from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
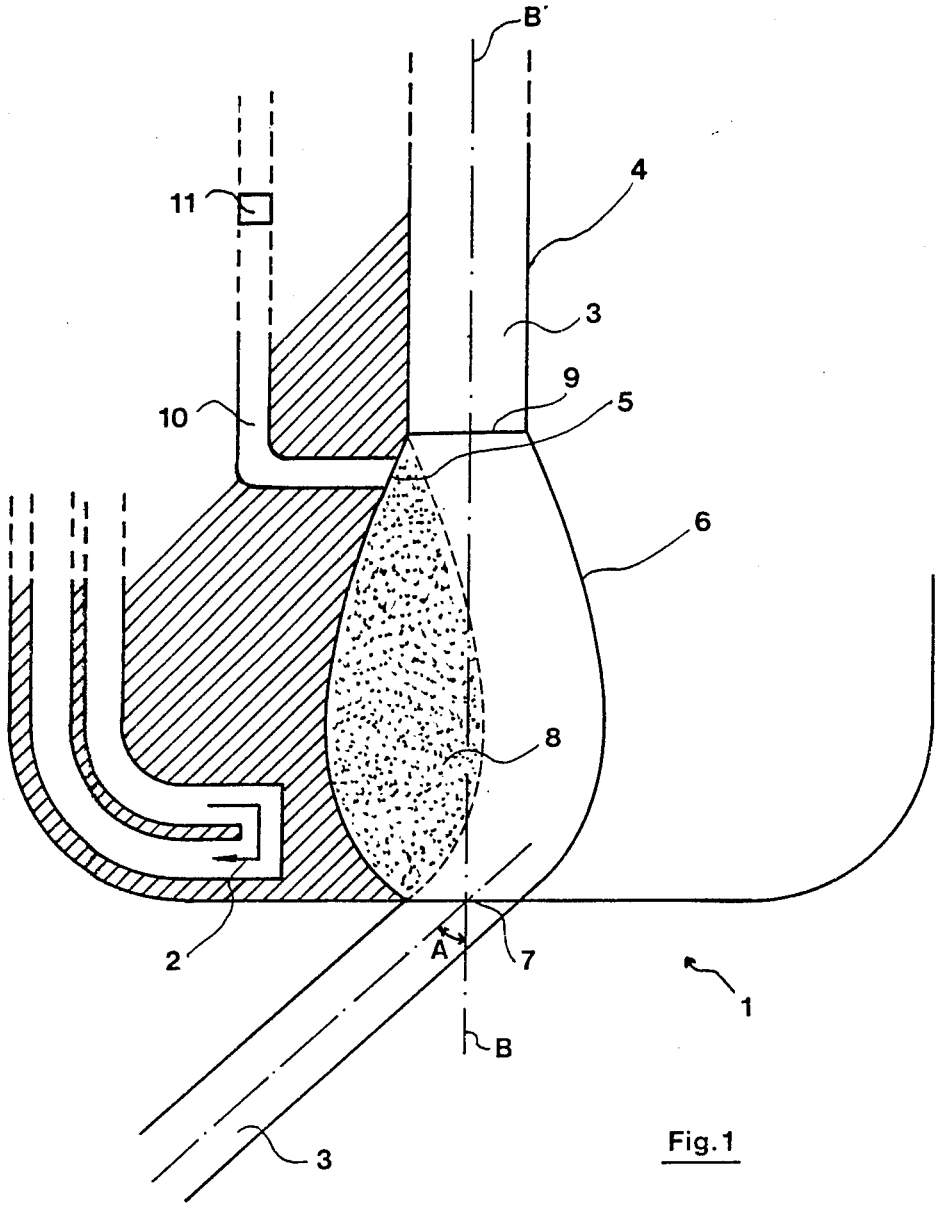
FIG. 1 is a schematic longitudinal cross section through a nozzle head in accordance with the present invention.

In FIG. 1, a portion (without secondary blast pipes, etc.) of a nozzle head in accordance with the present invention is shown generally at 1. Nozzle head 1 includes cooling means 2 (i.e., conduits) for cooling nozzle 1 by water circulation. A vertical blast pipe 4 directs a refining oxygen jet 3 (whose physical properties are determined by the pressure of the oxygen source, the flow control valve, and the profile and dimensioning of the oxygen ducts) from a source (not shown) to a chamber 6 located within an extension of blast pipe 4. Chamber, 6, which is connected at its upper end to blast pipe 4 at interface 9 and at its lower end to the exit opening or mouth 7 of nozzle 1 preferably has a length of about 30 cm. It will be appreciated that chamber 6 would have only a negligible effect upon the dynamics of oxygen jet 3 (slight increase in velocity, as a function of the cross section of mouth 7) if not for the additional exit openings or mouths 5 eminating from a plurality of lateral ducts 10, opening near the interface 9 where blast pipe 4 opens into (i.e., communicates with) chamber 6. In an effort to keep FIG. 1 simple and for the sake of clarity, only a single lateral duct 10 has been represented in FIG. 1. However, generally a plurality of ducts 10 are utilized and in the described embodiment, there are eight mouths 5, arranged symmetrically around mouth 9 of blast pipe 4. Preferably, at least three lateral ducts have their exit openings 5 arranged symmetrically around mouth 9 of blast pipe 4. Lateral ducts 10 direct a gas, preferably oxygen or air, in such a way that its direction of flow near mouth 5 is practically transverse to that of the principal or primary oxygen jet 3. The flow of gas passing through the various ducts 10 is regulated by means of valves 11, which may be of the known "on-off" type.

Chamber 6 is essentially pear-shaped, truncated at its upper and lower ends. The cross sectional area of mouth 7 is comparable to the cross sectional area of interface 9 (where chamber 6 is attached to blast pipe 4). The profile of the opening near the blast pipe 4 is less critical, but it must be sufficiently pronounced to achieve, over a distance of a few dozen centimeters, a progressive deflection of the jet up to the desired deflection A. At the approach to mouth 7, the angle taken by the interior profile of chamber 6 with respect to the longitudinal axis BB' of blast pipe 4 tends toward the desired deviation angle A. It follows that the realization of the interior profile of the chamber 6 takes into account the distance from mouth 7 to the surface of the bath, as well as the dimensions of the converter, or, more precisely, of the horizontal cross section of the converter at the normal height of the bath. Chamber 6 can be a body of revolution, or, opposite each mouth 5, may display grooves in which jet 3 flows. These grooves can have a depth such that they enclosed one-third of the area of jet 3, and can display a spiral configuration around the axis BB'. In this latter embodiment, the nozzle body is the locus not only of a force of reaction passing through axis BB', but also of a rotational force. Such grooving is shown, for example, in U.S. Pat. No. 4,366,953, assigned to the assignee hereof, all of the contents of which are incorporated herein by reference.

The functioning of the apparatus is as follows: Initially, only blast pipe 4 is connected to the oxygen source. The several valves 11 are closed. Thus, a strong vertical primary oxygen jet strikes the surface of the bath. When a deflection of the jet is desired, one of the valves 11 is actuated, and a jet of gas penetrates into chamber 6, and creates a zone of overpressure 8. This zone of overpressure causes a deflection of jet 3, which, while retaining its shape, bears against the wall of chamber 6 opposite mouth 5 (which creates overpressure zone 8). Due to suction phenomena caused by the primary oxygen jet, the quantity of gas necessary to create pocket 8 is substantial. However, once gas jet 3 has been deflected, only a minimal quantity of gas is necessary to preserve the overpressure zone and keep the jet deflected.

One embodiment of the present invention utilizes a computer to control the various valves 11 as a function of the course of the refining process. By opening the various valves 11, one by one, i.e., sequentially, as a function of the distribution of temperature in the converter (temperature profile at the surface of the bath, and temperature profile above the bath affected by the combustion of carbon monoxide), the point of impact can be guided along a more or less circular trajectory on the surface of the bath. It is also possible to sequentially open and close valves 11 with a preestablished frequency; which has the effect of creating at one time a central point of impact, and at another time a point of impact displaced along circular segments around the center of the bath.

Figure 2:
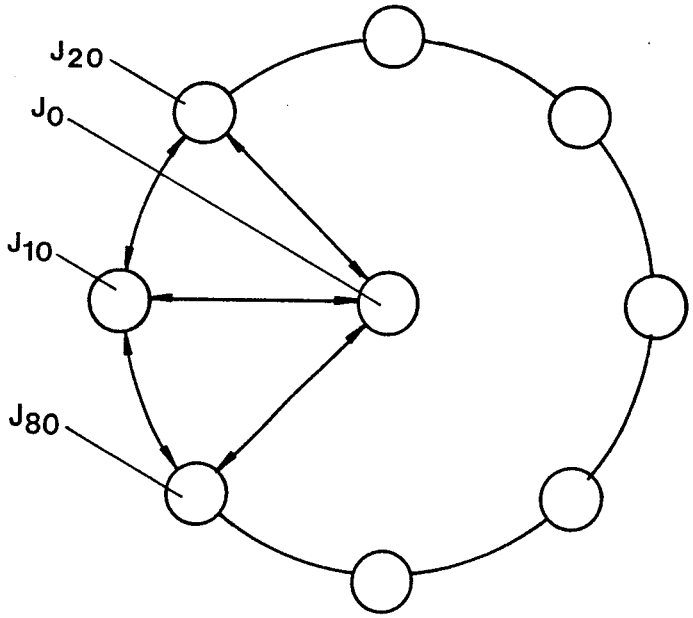
FIG. 2 is a diagrammatic representation of the variability of the positioning of the point of impact of the jet in accordance with one embodiment of the nozzle head of the present invention.

In FIG. 2, a schematic representation of the different points of impact achieved by means of a nozzle head comprising a vertical blast pipe whose jet can be deflected by eight lateral ducts 10 as described above is shown. The point $J_0$ is reached by keeping all eight valves 11 closed. By opening the valves 11 sequentially, it is possible to displace the jet, to reach for example the point of impact $J_{10}$, then $J_{20}$, . . . to $J_{80}$.

Thus, the nozzle head according to the invention makes it possible to direct the jet toward each of the impact points represented, in the direction of the arrows. Moreover, it is believed that preselected computer programs may be developed for sweeping the area, in accordance with an empirical formula; or to proceed in accordance with a given situation. For example, a determination may be made as to whether a defect has formed within the converter in a given zone. By effecting an intense sweeping of oxygen in that zone, said defect can be smelted.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A nozzle for use in refining metals or ferroalloys which includes a nozzle head terminating at a first mouth, the nozzle also including therein at least one blast pipe terminating at a second mouth, the blast pipe being adapted for directing a jet of refining oxygen, said nozzle further including:

chamber means interposed between said second mouth of said blast pipe and said first mouth of said nozzle head, said chamber means widening progressively from said blast pipe second mouth and narrowing toward said nozzle head first mouth; and at least one lateral duct communicating with said chamber means at an exit opening in the vicinity of said blast pipe second mouth, each of said at least one lateral ducts being associated with flow control valve means and being adapted for connection to a source of gas.

2. The nozzle according to claim 1 wherein:

at least three lateral ducts have exit openings which are arranged symmetrically around the second mouth of said blast pipe.

3. The nozzle according to claim 1 wherein:

said chamber means is a body of revolution having an essentially pear-shape which is truncated at top and bottom.

4. The nozzle according to claim 2 wherein:

said chamber means is a body of revolution having an essentially pear-shape which is truncated at top and bottom.

5. The nozzle according to claim 1 wherein said chamber means has an inner wall and wherein:

said inner wall of said chamber means includes grooves.

6. The nozzle according to claim 2 wherein said chamber means has an inner wall and wherein:

said inner wall of said chamber means includes grooves.

7. The nozzle according to claim 1 wherein the oxygen jet exits the outlet of said nozzle head first mouth at an angle of deflection and wherein:

the interior profile of said chamber means is dimensioned so that the profile angle at the outlet of said nozzle head first mouth corresponds to the angle of deflection of the oxygen jet.

8. The nozzle according to claim 1 wherein:

said second mouth of said blast pipe and said first mouth of said nozzle head have substantially equal cross sectional areas.

9. The nozzle according to claim 1 wherein:

said exit opening from said at least one laterial duct is positioned to direct gas in a direction substantially transverse to the direction of gas being delivered by said blast pipe.

* * * * *